United States Patent [19]

Garrison

[11] Patent Number: 4,886,116

[45] Date of Patent: Dec. 12, 1989

[54] NATURAL GAS PRODUCTION APPARATUS WITH BOTTOM-HOLE SEPARATOR

[76] Inventor: Clarence M. Garrison, 16 E. Main, Clarksville, Ark. 72830

[21] Appl. No.: 294,284

[22] Filed: Jan. 9, 1989

[51] Int. Cl.[4] ..... E21B 43/00

[52] U.S. Cl. ..... 166/105.5; 166/165; 166/267

[58] Field of Search ..... 166/265, 267, 313, 369, 166/370, 371, 372, 69, 105.5, 105.6, 165; 210/188

[56] References Cited

U.S. PATENT DOCUMENTS

| | | | |
|---|---|---|---|
| 3,873,238 | 3/1975 | Elfarr | 166/372 X |
| 4,366,861 | 1/1983 | Milam | 166/105.5 |
| 4,476,925 | 10/1984 | Cox | 166/236 X |
| 4,787,450 | 11/1988 | Andersen et al. | 166/372 X |

*Primary Examiner*—William P. Neuder
*Attorney, Agent, or Firm*—Robert R. Keegan

[57] ABSTRACT

There is disclosed apparatus for facilitating gas production in a flooded or partially flooded gas well. The well is provided with normal casing perforated in the production zone; tubing of about two inches in diameter is run from the surface inside the casing through the production zone, and the lower end is connected to a tool with a cylinder of about six inches diameter surrounding the tubing for a length from about ten to one hundred feet. The bottom of the cylinder is closed normally; fluid rising from the production zone passes through the restricted area between the cylinder and the casing. Means, such as a compressor, for injecting gas, normally gas from the well, is connected to the top of the tubing; the injected gas passes down the tubing and back up between the walls of the tubing and the cylinder at high velocity with a jet-like thrust between the tubing and the casing thereby causing a pull on the producing zone to enhance production. In some embodiments the cylinder has a pressure operated valve at the top to keep water from filling the tube while the tool is lowered in the hole. A check valve may be provided at the bottom of the cylinder which allows the well to be swabbed without pulling the tubing and which, in favorable circumstances, would allow the well to be produced through the tool without circulation of gas.

16 Claims, 2 Drawing Sheets

NATURAL GAS PRODUCTION APPARATUS WITH BOTTOM-HOLE SEPARATOR

The present invention relates to apparatus to enhance natural gas production particularly where such production is impeded by water in the well. The production of water, commonly salt water, along with the production of gas is a severe one and it results in heavy expenses to the well operator in disposing of large amounts of salt water and in pumping out water-flooded wells. A simple way of handling such liquids is to separate the liquids from the gas with conventional separators and dispose of the liquid in a suitable manner. Unfortunately, the liquid is often salt water or otherwise contaminated so that its diposition cannot be allowed to contaminate any fresh surface water or ground water in the locality. This complicates the disposal problem and may make it unreasonably expensive.

Some attempts to reduce the water flow have been made by choking the well at the surface. A specific example will serve to illustrate water suppression by surface choking. At production zone depth the gas and water are commonly separated into two layers contained in the porous rock. Some water is retained in the gas zone by capillary forces. Assuming the gas pressure is one thousand pounds per square inch in a thousand foot deep well, the pressure at the surface will be essentially one thousand pounds per square inch also; the weight of the gas in the casing and, hence, the pressure differential should amount to less than twenty pounds per square inch for a thousand foot well.

The pressure drop is associated with high velocity gas passing through the porous rock reducing the gas pressure at the foot of the casing to a much lower value, perhaps five hundred pounds per square inch. In the formation at a distance from the casing the pressure would not be reduced and would be approximately one thousand pounds per square inch. This tends to cause a migration of the water toward the casing where it will be entrained by the gas and carried to the surface in large amounts. With this model of a gas well it is apparent that choking the well at the top will increase the gas pressure at the foot; for example, from about five hundred pounds per square inch to perhaps nine hundred pounds per square inch. This would reduce the pressure differential tending to force the water toward the well to about one hundred pounds from the previous five hundred pounds and may be expected to substantially reduce the water production. It can be expected that the gas production will not be reduced as much as the water is reduced and thus the surface choking produces a desirable result from the point of view of reduced water disposal problems.

Surface choking of the well may have adverse effects, however. The reduction in gas velocity also reduces the ability of the gas flow to lift the water droplets out of the well. This may cause the well to gradually fill up with water, greatly reducing production or, in some cases, shutting it off entirely if the reservoir pressure is insufficient to overcome the pressure due to the depth of the water in the well.

In a worst case, the well may become blocked so that it yields no meaningful production and even capping it may not return it to such production for weeks or months. A possible explanation for this condition is that the capillary forces acting on the water in the porous rock provide a stabilizing effect on the plug of water standing in the casing. Water in the interstices in the vicinity of the foot of the casing may lose contact with the main body of water in the water zone. Water in the interstices having no direct connection with the water in the water zone, the full capillary force (or pressure) is effective to maintain the well in its blocked condition.

Apparatus according to the present invention contemplates placing a tube and cylinder structure in the bottom of the well which will tend to impede water production while permitting or enhancing gas production. This is believed to be a novel approach to the water encroachment problem in gas wells and provides advantages over simply removing the water and disposing of it or seeking to diminish the water flow by surface choking the well.

Apparatus for separating liquids and gases at the bottom of a well casing has been proposed as in U.S. Pat. No. 4,366,861 to J. K. Milam, granted Jan. 4, 1983. This apparatus is directed to a different purpose of providing a down-hole gas separator to be secured to the lower end of a down-hole rod pump in a producing oil well for the purpose of separating the gas from the liquid hydrocarbons which are being produced by the well pump. The apparatus of the present invention is distinctly different both in structure and function from the apparatus of Milam.

In addition to providing the features and advantages described above, it is an object of the present invention to provide downhole apparatus for facilitating gas production in a partially flooded gas well including a tubing extending from the surface to the production zone and a cylindrical shield around the bottom end of said tubing having a diameter about one-half to three-quarters the diameter of the well casing whereby a partial choking effect is produced in the bottom of the well to achieve a higher ratio of gas production to liquid production out of the well.

It is another object of the present invention to provide a tube and cylinder structure at the bottom of the well with said tube connected to a source of pressurized gas at the surface whereby a gas passes down the tubing and back up between the walls of the tubing and the cylinder at high velocity with a jet-like thrust between the tubing and the casing causing a pull on the producing zone to enhance production.

It is a still further object of the present invention to provide apparatus as described above having a pressure operated valve sealing the top of the space between the cylinder and the tubing so that the apparatus can be lowered in position without having water fill the tubing.

It is yet another object of the present invention to provide apparatus as described above wherein the normally closed-off bottom of the cylinder and tubing contains a check valve to allow the well to be swabbed without pulling the tubing and to allow the well to be produced through the tool and the tubing without injection of gas in certain circumstances.

Other objects and advantages of the invention will be apparent from consideration of the following description in conjunction with the appended drawings in which.

Figure 1:
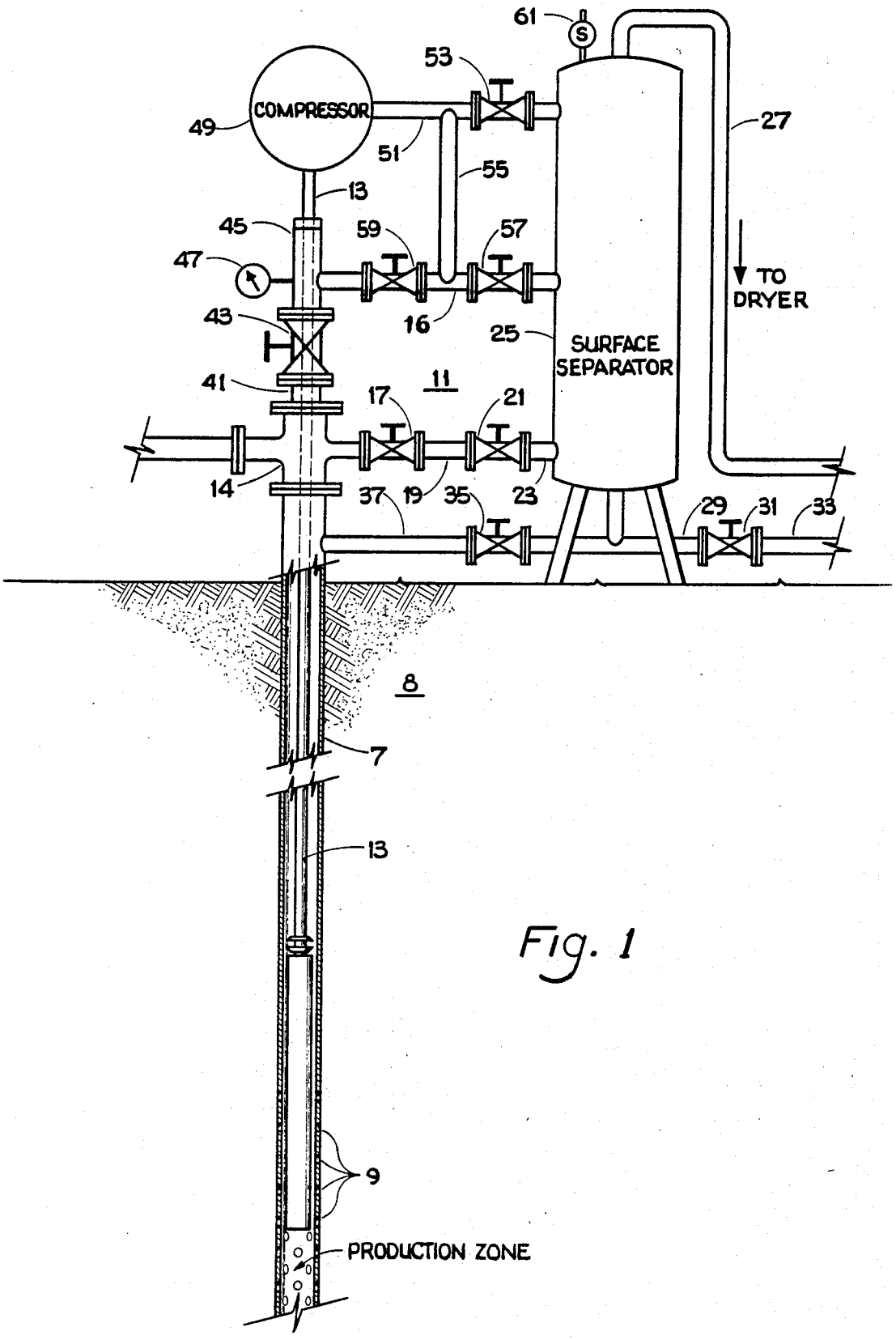
FIG. 1 is a schematic diagram of gas production apparatus according to the invention.

Referring now to the drawings and particularly to FIG. 1, natural gas production apparatus 11 is shown according to the invention. The apparatus 11 is applied to a gas well drilled by conventional means wherein a casing 7 preserves the integrity of the hole in the subsurface strata 8. Casing 7 is provided with perforations 9 in the well production zone in a conventional fashion. A tubing 13 which may be about two inches in diameter runs from the vicinity of the production zone to and through a well-head 14 to a compressor 49. The outlet of compressor 49 is connected to tubing 13.

A conduit 41 connects to well-head 14 and a valve 43 is interposed therein for control of gases or liquids which may be produced through casing 7 during start-up, maintenance, or other operations. Fluids from the well are passed through well-head 14, valve 43, conduit 45 and through conduit 16 having valves 59 and 57 to surface separator 25. Surface separator 25 is of conventional construction and serves to perform a preliminary separation of liquids and gases in the stream from casing 7. Production gases may be conducted from surface separator 25 through a conduit 27 to a conventional dryer which further eliminates liquids from the gas before it is received into a storage unit or a feeder pipe of a pipeline.

Liquids from surface separator 25 are conducted to a conduit 29 having valves 31 and 35 interposed therein; valve 31 controls liquid flow to a holding tank for future disposal and valve 35 controls flow of liquid back into the casing 7. An additional outlet for well-head 14 is shown which may or may not be used.

A conduit 51 having a valve 53 is provided for gas flow from surface separator 25 to the inlet for a compressor 49. Branch conduit 55 permits gas flow from the well and compressor 49 to pass to the inlet of surface separator 25, when compressor 49 is inoperative. A bypass (not shown) around compressor 49 may be provided if necessary.

A conduit 19 accommodates fluid flow from surface separator 25 to the well which passes through shut-off valves 17 and 21 into well-head 14.

Gas pressure may be measured by a pressure gauge 47 and, of course, other conventional gauges and instruments may be utilized with the apparatus. A pressure relief or safety valve 61 is provided for the surface separator 25, also in conventional fashion.

Figure 3:
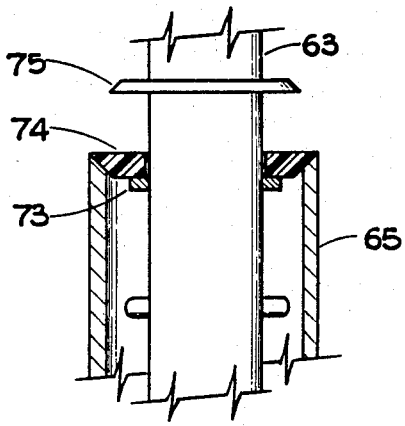
FIG. 3 is an enlarged detail view of FIG. 2.
Figure 4:
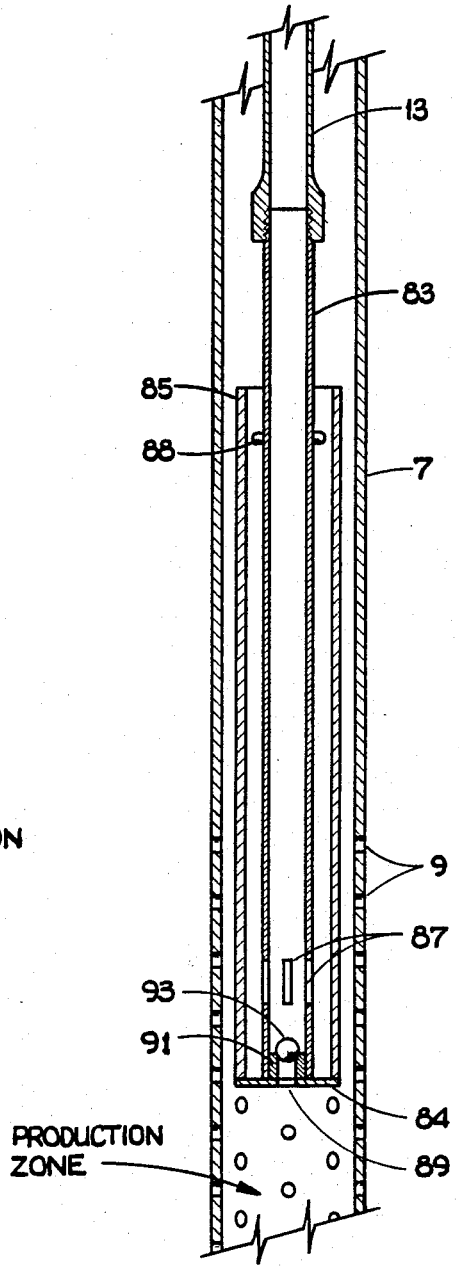
FIG. 4 is an enlarged detail sectional view of an alternative construction for the downhole portion of the apparatus.

The apparatus previously described with the exception of the tubing 13 and the compressor 49 is generally conventional or may be replaced by conventional apparatus. It will be appreciated that conventional details concerning pumps, holding tanks, filters, dryers, etc. are omitted as they do not form a part of the invention. Novel apparatus according to the invention is shown in FIGS. 2, 3, and 4, FIGS. 2 and 3 showing a first embodiment of the invention and FIG. 4 showing a second embodiment thereof.

Figure 2:
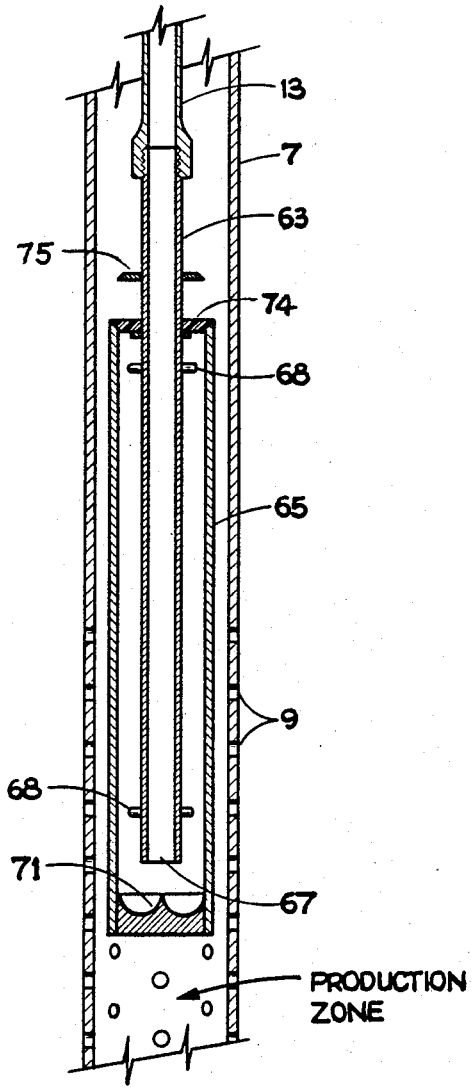
FIG. 2 is an enlarged fragmentary sectional view of a portion thereof.

Referring to FIG. 2, tubing 13 has an extension 63 connected thereon by a threaded joint or other suitable manner which extension 63 has an open end 67.

Extension 63 has secured surrounding the lower end thereof a cylinder 65 held generally concentrically with extension 63 by struts 68.

A flow reversing element 71 closes the bottom of cylinder 65 and causes gas injected through tubing 13 to smoothly reverse direction and flow upwardly in the cavity between extension 63 of tubing 13 and the inside wall of cylinder 65. A disc 74 with a central opening is urged by gravity to close the opening at the top of cylinder 65. Disc 74 may be of rubber, plastic, or other suitable material providing good sealing engagement with the top of cylinder 65. It may be restrained from unlimited upward movement by flange 75 and may be provided with a seat 73 to seal the small gap between the opening in disc 74 and the extension 63. Disc 74 allows the apparatus of extension 63, cylinder 65, and associated parts to be lowered into a partially water-filled well without having water fill the interior of cylinder 65 of extension 63 or of tubing 13. Whenever pressure is built up in cylinder 65 by the injection of gas through tubing 13, disc 74 lifts and tubing 65 becomes effectively open at the top.

When a relatively small amount of gas is pumped through tubing 13 and extension 63 from surface separator 25 down into the bottom of the well, the flow is reversed and directed upwards between the tubing 13 and the casing 7. This action tends to cause a turbulent flow upward in the casing breaking up the salt water into droplets. This action also breaks the effects the hydrostatic pressure upon the gas and will allow the gas to seek or follow the path of the least resistance.

The gas being so much lighter than the salt water will generally flow through the salt water leaving most of it in the hole. The turbulence generated will keep the gas filtering through the salt water and cause a continuous separation of the gas and salt water so long as the circulation continues. Gas received at the well-head will go back into the surface separator 25 and a major portion thereof will be taken off through conduit 27 to a dryer or further processing apparatus and thence to a main marketing line or distribution line.

The tool of FIGS. 2 and 3 is a preferred embodiment for wells to 4,000 feet in depth. This tool is attached to the bottom of the tubing and then run into the hole. This tool is designed to be used to circulate a small amount of the production of the well by a pump such as compressor 49 down through the tubing 13 hitting the reversing shoe 71 and directing the flow up with a jet-like thrust between the tubing 13 and the casing 7. This action will cause a pull on the producing zone to enhance production.

The tool is closed at the bottom and has a valve 73, 74 at the top of the sleeve cylinder 65, the function of the valve is to keep the water from filling the tubing with water while going in the hole with the tool. If there should be a high level of water in the hole, this will make it easier to get circulation of the gas started.

This tool is designed to enhance production and control the water in the well, with the combined use of a compressor to force circulation and also to force the well to produce in spite of the water which is an enormous problem in a great many cases. Hundreds of wells are being plugged for the lack of some way to handle the water.

FIG. 4 shows an alternative embodiment of the invention in which an extension 83 is engaged to the bottom of tubing 13 by a threaded joint or otherwise and has at its lower end a plurality of windows which may be three or four in number. Windows 87 may typically be about ⅜ inches in width by about 4 inches in height. As previously explained with reference to FIG. 2, gas is injected downwardly through tubing 13 or caused to pass outwardly through windows 87 into the space between the outer surface of extension 83 and the inner surface of a cylinder 85 (which is generally similar to the cylinder 65 in FIG. 2). Although the apparatus of FIG. 4 is not shown as being provided with a disc 74 for closing the top of cylinder 85, such a closure or an equivalent device could be provided if desired.

Cylinder 85 of FIG. 4 is closed at the bottom by a circular plate 84 having an opening 89 and a ball 93 having a seat 91. Ball 93 acts as a check valve so that when the interior of extension 83 is pressurized the bottom thereof is closed off by check valve action, but compressor 49 may be deactivated so that tubing 13 and extension 83 is not pressurized and, in certain circumstances, gas may be produced through the opening 89, extension 83, and tubing 13. The check valve action of ball 93 and seat 91 also allows the well to be swabbed without pulling the tubing.

The tool of FIG. 4 is to be screwed onto the bottom of the producing string of tubing in the same manner as the tool of FIGS. 2 and 3.

This tool is to be used on almost all wells that are plagued with water. The design is different where it has a ball and seat check valve in the bottom of the tool with windows 87 at the extreme end of the tool extension 88. Otherwise the tools serve the same purpose.

These check valves 91 and 93 will allow the well to be swabbed without pulling the tubing, also it allows the well to be produced through the tool, without the circulation employed in the tool of FIGS. 2 and 3. The hole 89 in the bottom of tool may act as a restriction to control the water and/or hold the water back and let the gas come in more easily.

The swabbing of the well mentioned above is necessary in almost all cases where the salt water comes in with the gas, to lower the build-up level of the water in the hole so the pressure on the zone is reduced to a point that the zone pressure is greater than the weight of the water. That will offset the balance of water and the zone pressure so the well can start producing again.

This tool will reduce or eliminate the necessity of frequent swabbing and allow some wells to continuously produce without interruption.

It should be pointed out that the cylinder of 65 of FIG. 2 or the cylinder 85 of FIG. 4 both produce the effect of a restricted opening in the bottom of the casing thereby choking the flow of gas at the bottom of the well rather than doing so in a conventional manner at the surface. This, in effect, would maintain a higher pressure at the bottom of the well and on the producing zone which may be an important factor in controlling the influx of salt water. In certain circumstances, or at certain stages of the operation, the bottom well choking effect may be sufficient of itself without the necessity for inducing gas circulation with compressor 49.

The diameters and dimensions of the elements of the apparatus of FIGS. 2, 3, and 4 may vary depending upon the diameter of the casing 7 in the well in which they are used. Obviously the cylinder 65 or the cylinder 85 must be substantially smaller than the inside diameter of the casing 7 so that it can be readily lowered into the well. In most cases the diameter of the casing 7 will fall in the range of from four to eight inches and a practical diameter for cylinder 65 or cylinder 85 is about three-quarters of the inside diameter of casing 7. Tube 13 may be one and one-half or two inches in most cases. Conditions encountered in a gas well are subject to wide variation and practical adjustments in dimensions of the downhole apparatus may be indicated to suit such conditions. The length of cylinder 65 or cylinder 85 is widely variable. Significant advantages may be achieved with a cylinder of from six to eight feet in some cases and a cylinder length of a hundred feet or more may prove advantageous. Long versions of the apparatus may be handled more conveniently if made in sections to be threaded or otherwise secured together.

In addition to the variations and modifications of the invention shown or suggested, it will be apparent to those skilled in the art that other variations and modifications may be made within the scope of the invention and accordingly the scope of the invention is not to be deemed limited to the specific embodiment or modifications shown or suggested but is rather to be determined by reference to the appended claims.

What is claimed is:

1. Apparatus for facilitating gas production in flooded or partially flooded wells having a casing extending from above to below the production zone and perforations at the production zone comprising a well head device connected for receiving fluids from said well through the top of said casing, a surface separator, a conduit connecting said well head device to said surface separator and having at least one valve therein, a gas compressor, a tube having a diameter substantially less than the diameter of said casing located within said casing and extending from said production zone upward through said well head device to said gas compressor, a conduit connected from said gas compressor to receive gas from said surface separator, a cylinder having a diameter intermediate between the diameters of said tube and said casing and being open at the top end and closed at the bottom end and mounted concentrically to a bottom end portion of said tube and extending at least ten feet upwardly from the bottom thereof, and means for conducting a controllable portion of the liquid output from said surface separator back to the interior of said casing.

2. Apparatus as recited in claim 1 wherein said cylinder has a valve member at the top thereof which is normally closed but is arranged to open when the pressure inside of said cylinder exceeds the pressure outside of said cylinder.

3. Apparatus as recited in claim 1 wherein the bottom of said cylinder is closed except for an opening with a diameter less than half the diameter of said cylinder.

4. Apparatus as recited in claim 3 wherein the opening in the bottom of said cylinder has a pressure operated valve therein which opens when the pressure outside of said cylinder is greater than the pressure inside of said cylinder.

5. Apparatus as recited in claim 4 wherein said valve is a ball check valve.

6. Apparatus for facilitating gas production in flooded or partially flooded wells having a casing extending from above to below the production zone and perforations at the production zone comprising a well head device connected for receiving fluids from said well through the top of said casing, a surface separator, a conduit connecting said well head device to said surface separator and having at least one valve therein, a gas compressor, a tube having a diameter substantially less than the diameter of said casing located within said casing and extending from said production zone upward through said well head device to said gas compressor, a conduit connected from said gas compressor to receive gas from said surface separator, and a cylinder having a diameter intermediate between the diameters of said tube and said casing, said cylinder having an opening at the top end and a closure at the bottom end and being mounted concentrically to the bottom end of said tube and extending at least six feet upwardly from the bottom thereof.

7. Apparatus as recited in claim 6 further including a valve at the top of said cylinder comprising a disc slidably mounted on said tube and aranged to close said opening when the pressure inside of said cylinder does not exceed the pressure outside of said cylinder.

8. Apparatus as recited in claim 6 wherein the bottom of said cylinder is closed except for an opening with a diameter less than half the diameter of said cylinder.

9. Apparatus as recited in claim 8 wherein the opening in the bottom of said cylinder has a pressure operated valve therein which opens when the pressure outside of said cylinder is greater than the pressure inside of said cylinder.

10. Apparatus as recited in claim 9 wherein said valve is a ball check valve.

11. Apparatus as recited in claim 6 further including means for conducting a controllable portion of the liquid output from said well head device back to the interior of said casing.

12. Apparatus for facilitating gas production in flooded or partially flooded wells having a casing extending from above to below the production zone and perforations at the production zone comprising a well head device connected for receiving fluids from said well through the top of said casing, a tube having a diameter substantially less than the diameter of said casing located within said casing and extending from said production zone upward through said well head device, and a cylinder having a diameter intermediate between the diameters of said tube and said casing with an opening at least at one of the top and bottom ends and mounted concentrically to the bottom end of said tube and extending at least ten feet upwardly from the bottom thereof, said cylinder having a valve member at the top thereof which is normally closed but is arranged to open when the pressure inside of said cylinder exceeds the pressure outside of said cylinder.

13. Apparatus as recited in claim 12 wherein the bottom of said cylinder is closed except for an opening with a diameter less than half the diameter of said cylinder.

14. Apparatus for facilitating gas production in flooded or partially flooded wells having a casing extending from above to below the production zone and perforations at the production zone comprising a well head device connected for receiving fluids from said well through the top of said casing, a tube having a diameter substantially less than the diameter of said casing located within said casing and extending from said production zone upward through said well head device, and a cylinder having a diameter intermediate between the diameters of said tube and said casing with an opening at least at one of the top and bottom ends and mounted concentrically to the bottom end of said tube and extending at least ten feet upwardly from the bottom thereof, the bottom of said cylinder being closed except for an opening with a diameter less than half the diameter of said cylinder, the opening in the bottom of said cylinder having a pressure operated valve therein which opens when the pressure outside of said cylinder is greater than the pressure inside of said cylinder.

15. Apparatus as recited in claim 14 wherein said valve is a ball check valve.

16. Apparatus as recited in claim 12 wherein said valve member at the top of said cylinder comprises a disc slidably mounted on said tube and arranged to close said opening when the pressure inside of said cylinder does not exceed the pressure outside of said cylinder.

* * * * *